US005974624A

United States Patent [19]

Eisen

[11] Patent Number: 5,974,624

[45] Date of Patent: Nov. 2, 1999

[54] WET VACUUM ACCESSORY FOR A VACUUM CENTER

[76] Inventor: Mark B. Eisen, 567 Deloraine Avenue, Toronto, Ontario, Canada, M5M 2C5

[21] Appl. No.: 08/844,332

[22] Filed: Apr. 18, 1997

[30] Foreign Application Priority Data

Apr. 24, 1996 [CA] Canada ..... 2174904

[51] Int. Cl.[6] ..... A47L 7/00

[52] U.S. Cl. ..... 15/353; 15/344

[58] Field of Search ..... 15/353, 344

[56] References Cited

U.S. PATENT DOCUMENTS

| | | | |
|---|---|---|---|
| 4,179,769 | 12/1979 | Lundquist | 15/353 |
| 4,536,914 | 8/1985 | Levine | 15/344 X |
| 4,675,936 | 6/1987 | Rawlins | 15/353 |
| 4,798,613 | 1/1989 | Hetherington et al. | 15/353 X |
| 5,263,224 | 11/1993 | Lovelady | 15/353 |
| 5,377,383 | 1/1995 | Christensen | 15/344 X |
| 5,634,238 | 6/1997 | McCaffrey et al. | 15/353 |

*Primary Examiner*—Chris K. Moore

[57] ABSTRACT

The invention provides a wet vacuum accessory for a domestic vacuum cleaner that separates liquid droplets from the suction airstream before the airstream is drawn into the vacuum cleaner intake hose. A suction intake passage is formed between a pair of baffles, which discharges the airstream into a reservoir that is isolated from the airflow outlet of the accessory body by the baffles. The reservoir is provided with a relatively large cross sectional area, which reduces the suction airstream velocity sufficiently to allow liquid entrained in the airstream to fall into the reservoir before the airstream is drawn out of the accessory into the vacuum cleaner intake hose. In the preferred embodiment a hollow handle of the accessory is provided for connection to the vacuum cleaner intake hose.

20 Claims, 5 Drawing Sheets

WET VACUUM ACCESSORY FOR A VACUUM CENTER

FIELD OF INVENTION

This invention relates to cleaning devices. In particular, this invention relates to a wet vacuum accessory for a vacuum cleaner for cleaning liquid spills.

BACKGROUND OF THE INVENTION

The domestic vacuum cleaner is the most common power cleaning tool used in households today. A conventional domestic vacuum cleaner provides a motor driven impeller which creates a suction airstream and draws or blows the airstream through a dirt collector such as an air permeable filter bag or a canister. Dirt and dust pass through the collector and are removed from the airstream, which then escapes into the environment. A typical domestic vacuum cleaner cannot vacuum a liquid, because liquid droplets entrained in the airflow would travel through and damage or destroy the impeller assembly and/or the collector.

Canister vacuum cleaners are available which are adapted to vacuum a liquid, often called "wet-vacuums", which provide a reservoir beneath the impeller assembly into which liquid entrained in the suction airstream is released. In such wet vacuum cleaners the impeller assembly and its associated electrical connections must be kept well away from both the high velocity airstream discharged from the suction intake and liquid collected in the reservoir, to ensure that the impeller assembly is completely isolated from any liquid. Except for these differences, wet vacuums tend to have all of the same components as a conventional canister vacuum cleaner and are to a large degree redundant in this respect.

Hand-held wet vacuums are also available, but they tend to be weak and ineffective because the battery-powered motors that they use are capable of generating only a very low pressure suction airstream, and they often utilize elaborate systems of baffles in order to maintain sufficient operating pressure while isolating the impeller from the suction intake and the reservoir to ensure that no water is drawn through the impeller assembly.

The present invention overcomes these disadvantages by providing a wet vacuum accessory for a domestic vacuum cleaner that separates liquid droplets from the suction airstream before the airstream is drawn into the vacuum cleaner intake hose. The invention provides a suction air intake passage defined between a pair of baffles, which discharges the suction airstream into a reservoir that is isolated from the airflow outlet from the body of the accessory by the baffles themselves. The reservoir is provided with a relatively large cross sectional area, which reduces the suction airstream velocity sufficiently to allow liquid entrained in the airstream to fall into the reservoir before the air is drawn out of the accessory body into the vacuum cleaner intake hose. In the preferred embodiment both the suction passage and the airflow outlet are located at the front end of the accessory, separated by the baffles that define the suction intake passage, and a hollow handle of the accessory is used as an extension to connect the vacuum cleaner intake hose to the airflow outlet.

The present invention thus provides an accessory for a vacuum cleaner for cleaning liquid, comprising means for creating a higher suction airstream velocity region comprising a suction intake passage having a suction inlet and a suction outlet, defined between a pair of baffles, a lower suction airstream velocity region contained within a body of the accessory comprising a reservoir in communication with the suction outlet, and an airflow outlet for attachment to a suction intake of the vacuum cleaner, for drawing the suction airstream out of the body of the accessory, whereby the airflow outlet is isolated from the suction outlet by the baffles such that the suction airstream must pass through the reservoir before egressing from the airflow outlet.

BRIEF DESCRIPTION OF THE DRAWINGS

In drawings which illustrate by way of example only a preferred embodiment of the invention.

DETAILED DESCRIPTION OF THE INVENTION

Figure 1:
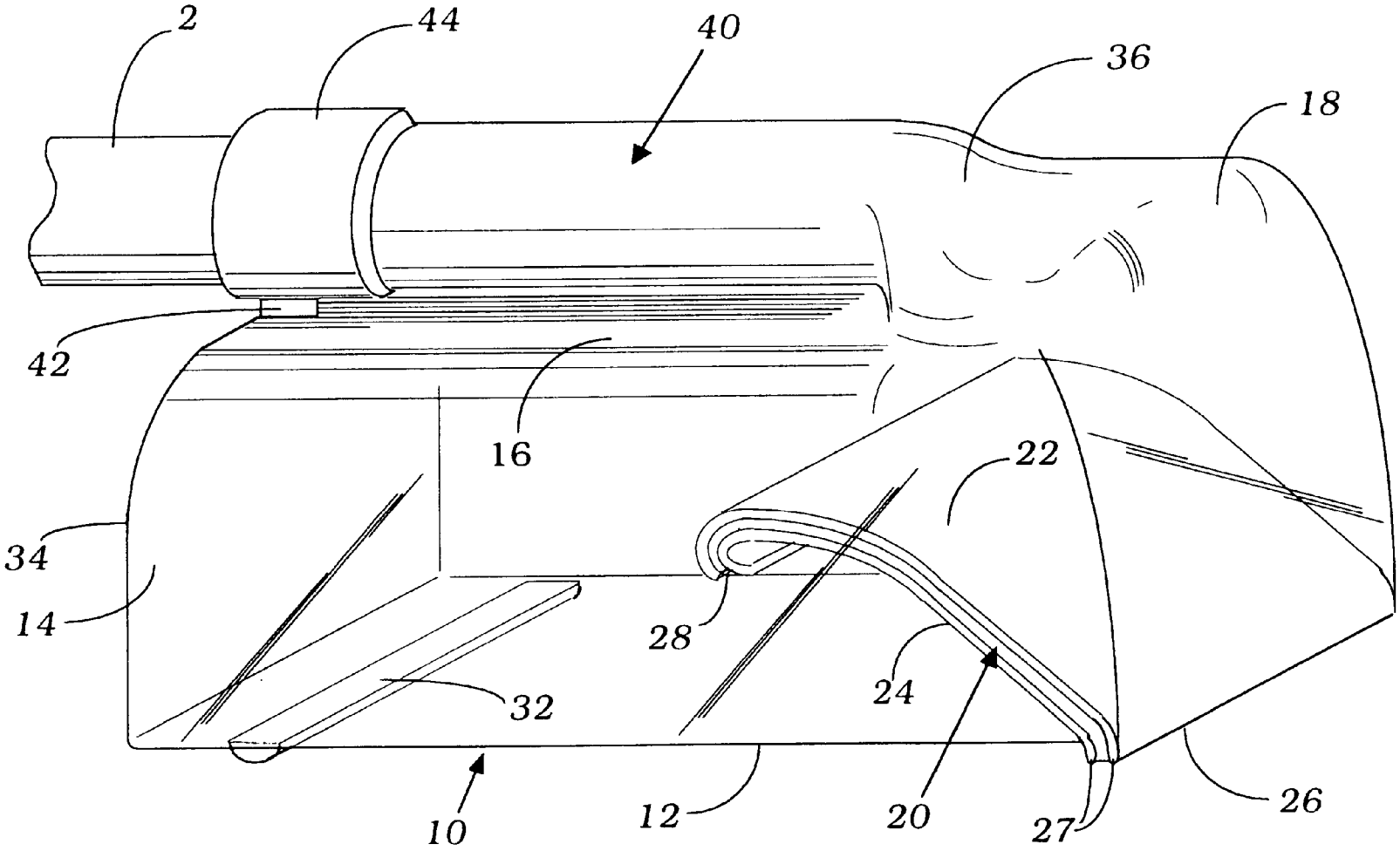
FIG. 1 is a perspective view of the wet vacuum accessory according to one preferred embodiment of the invention.

As illustrated in FIG. 1, the wet vacuum accessory comprises a body 10 containing a suction passage 20 and a reservoir 30, and a handle 40. Preferably the entire wet vacuum accessory is injection molded in left and right halves which are bonded along a longitudinal seam, although the accessory may also be constructed from sheet plastic or by any other suitable method. The accessory may be composed of a transparent or translucent plastic, enabling the user to see the liquid level in the reservoir 30.

Means for creating a higher velocity suction airstream comprises a suction intake passage 20 formed between upper and lower baffles 22, 24 and comprises a suction inlet 26 projecting slightly beyond the bottom 12 of the body 10 and a suction outlet 28 directed downwardly toward the reservoir 30 and preferably slightly toward the underside of the baffles 22, 24 for reasons which will be explained below. The baffles 22, 24 extend fully between the sides 14 so that the suction passage 20 is airtight from the suction inlet 26 to the suction outlet 28, defining a higher suction airstream velocity region. The baffles 22, 24 are preferably oriented obliquely as a ramp, allowing the suction outlet 28 to be positioned well above the reservoir 30 while reducing the suction pressure needed to draw liquid through the suction intake passage 20 against the force of gravity.

The spacing between the upper and lower baffles 22, 24 is selected to maximize the velocity of the suction airstream in the higher suction airstream velocity region without significantly impeding the airflow. Thus, the cross-sectional area along the suction intake passage 20 should be uniform and should approximate the cross-sectional area of the wand 2.

At the suction outlet 28 the suction intake passage 20 discharges into the reservoir 30, which is a lower suction airstream velocity region. The reservoir 30 is contained within the body 10 of the accessory, defined between the sides 14, the back 34 and the lower baffle 24. The reservoir 30 is water-tight to retain collected liquid without leaking.

Figure 2:
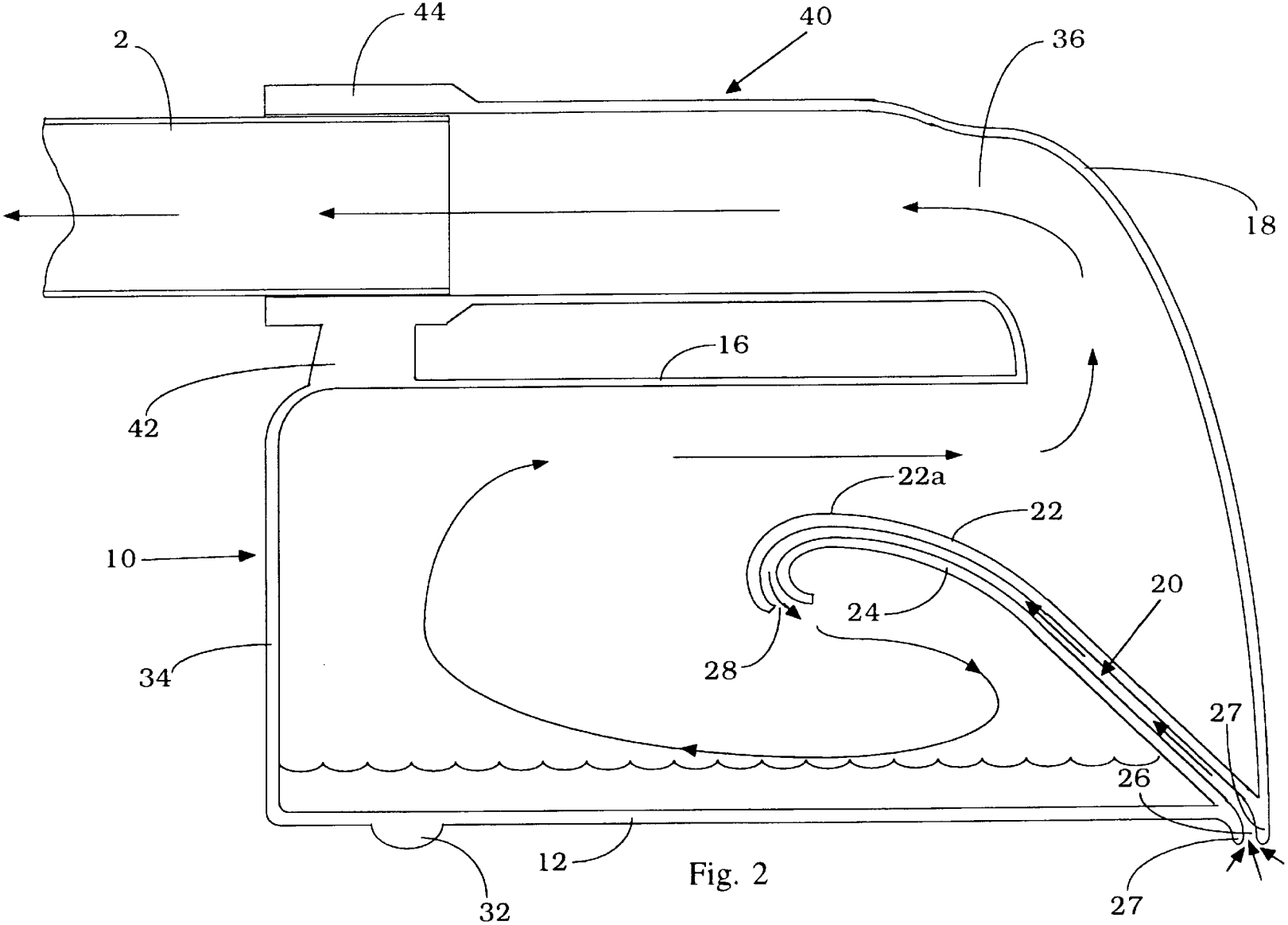
FIG. 2 is an elevational cross section of the accessory of FIG. 1.
Figure 3:
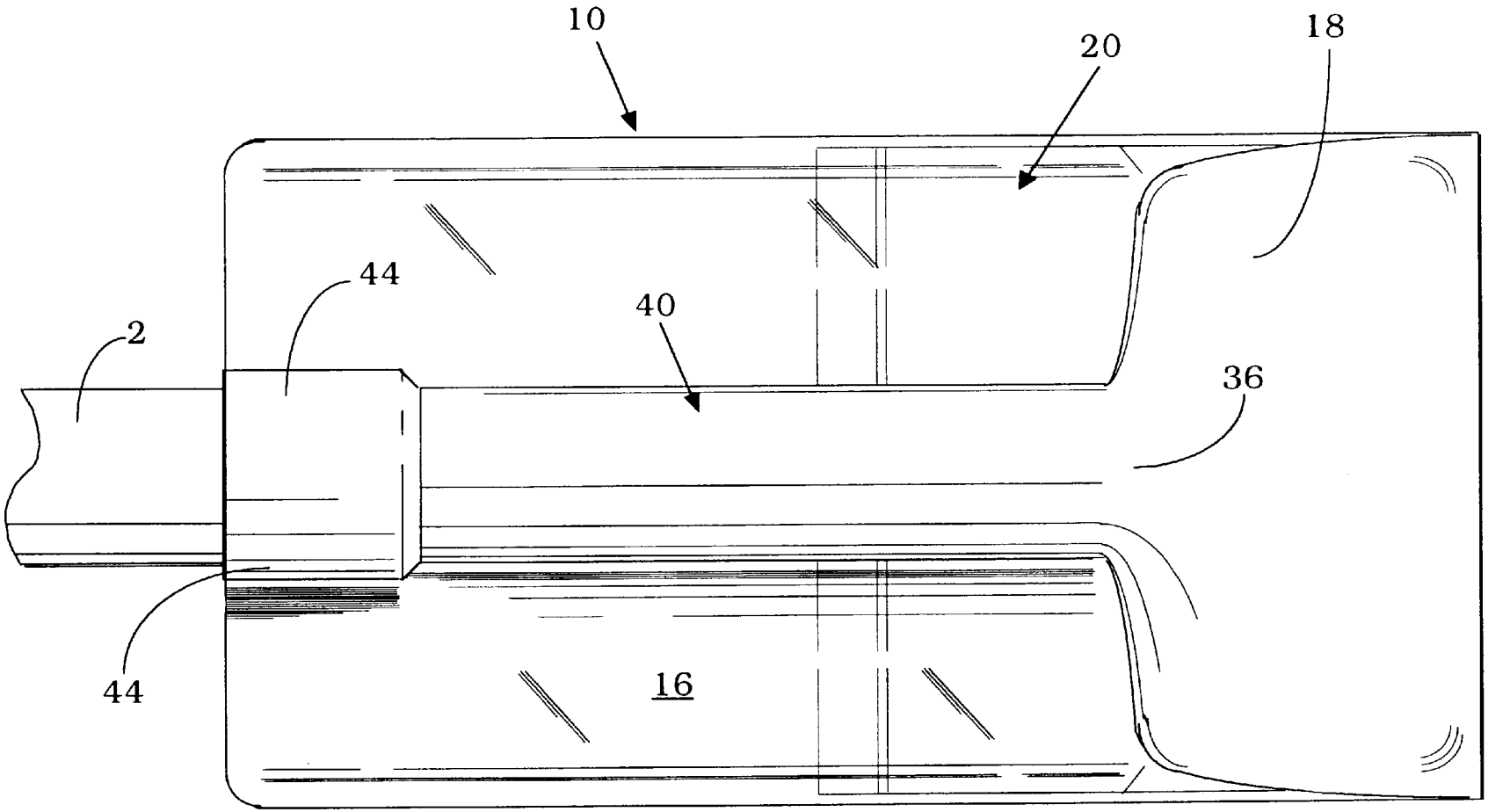
FIG. 3 is a top plan view of the accessory of FIG. 1.
Figure 4:
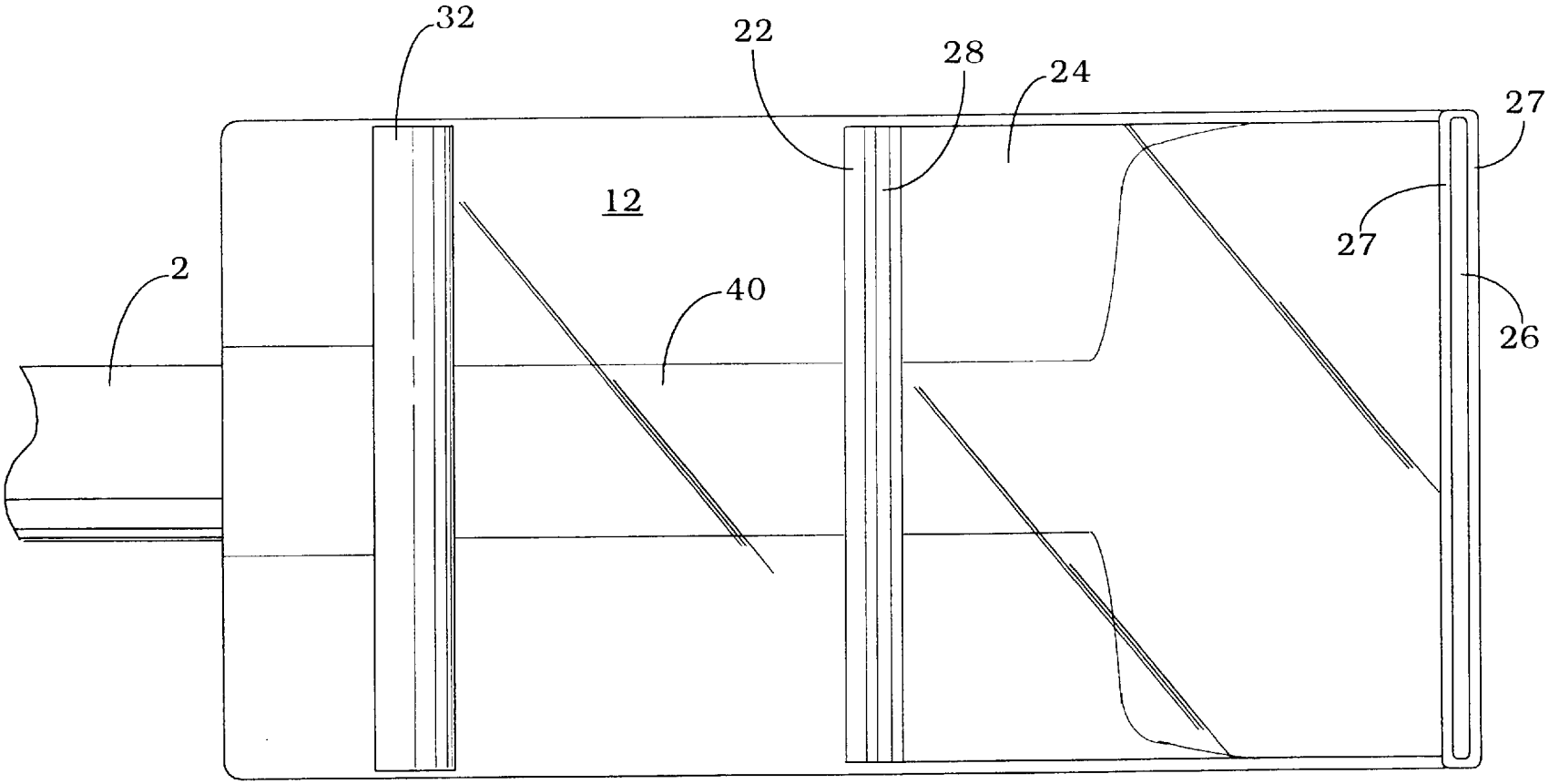
FIG. 4 is a bottom plan view of the accessory of FIG. 1.
Figure 6:
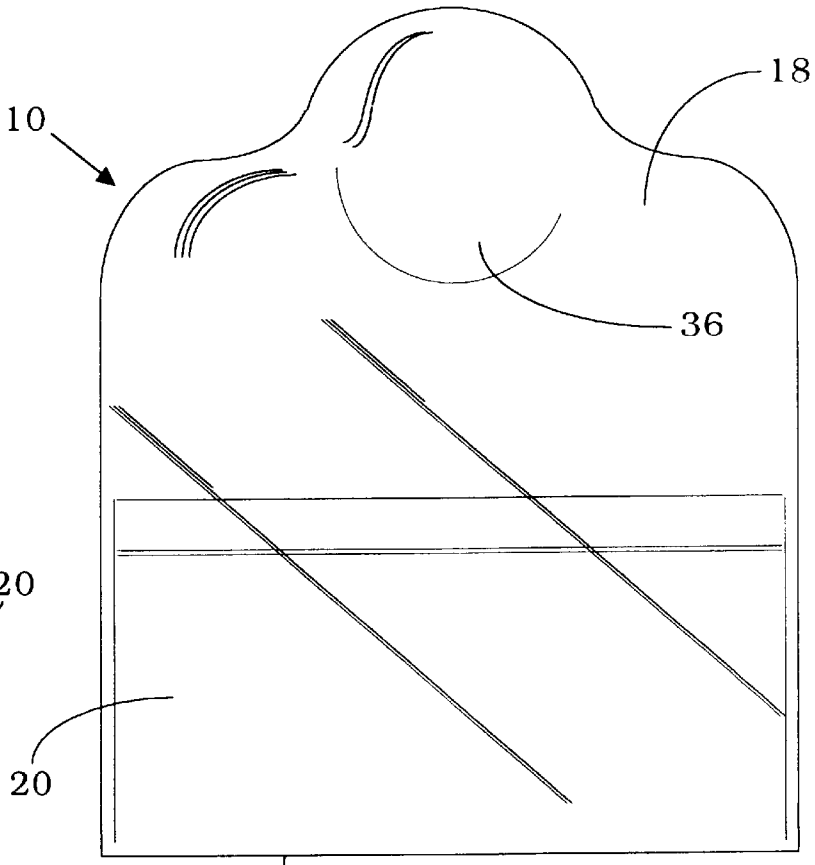
FIG. 6 is a front elevation of the accessory of FIG. 1.
Figure 5:
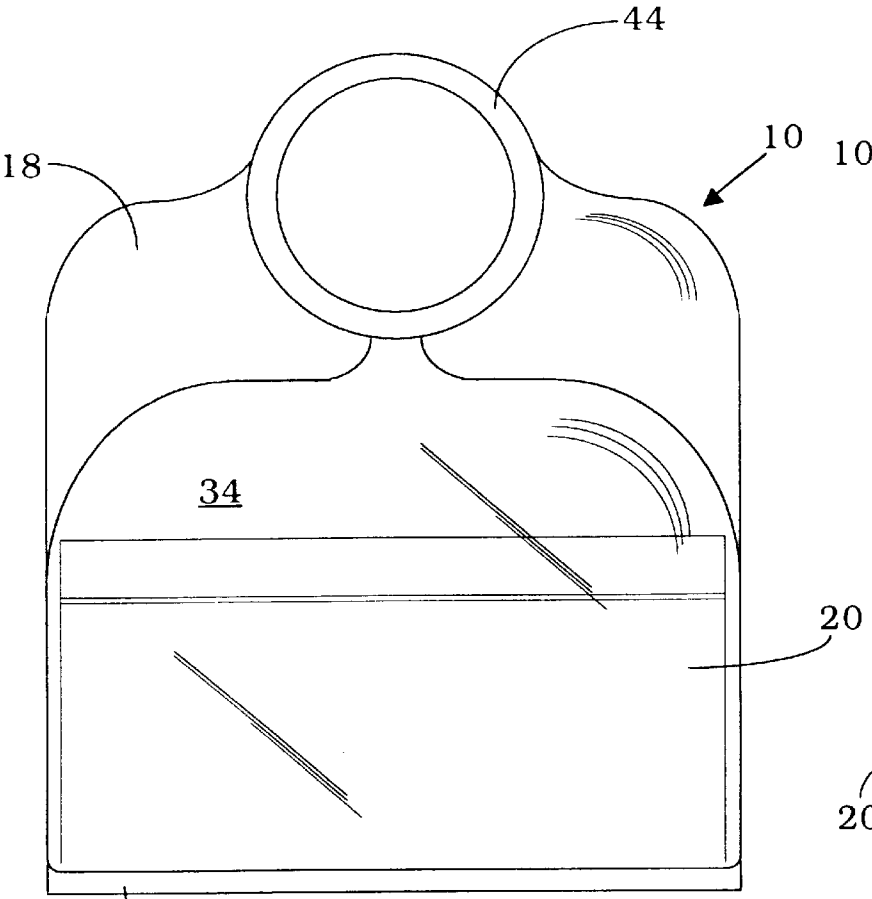
FIG. 5 is a rear elevation of the accessory of FIG. 1.

The handle 40 is supported by the head 18 at the airflow outlet 36 and by a post or web of plastic 42 near the back 34 of the accessory, preferably with a sufficient clearance above the top 16 of the accessory to allow a user's fingers to curl under the handle 40 for easier handling during use. The handle 40 is essentially a hollow tube which extends the wand 2 of a typical domestic vacuum cleaner intake hose (not shown) to bring it into fluid communication with the airflow outlet 36, through which the suction airstream is drawn from the body of the accessory. The handle 40 is preferably formed integrally with the body 10 and merges into the head 18 in a curving fashion, without any sharp corners, to minimize disruption of the suction airstream. At its rear end the handle 40 provides a receptacle 44 adapted to snugly receive the wand 2. As illustrated in FIG. 2, the receptacle 44 may be formed thicker than the rest of the handle 40 for reinforcement.

The clearance between the apex 22*a* of the upper baffle 22 and the top 16 of the body 10 should be significantly larger than the spacing between the baffles 22, 24, so that the passage between the reservoir 30 and the airflow outlet 36 is also a region of lower suction airstream velocity. This helps to ensure that liquid collected in the reservoir 30 does not become re-entrained in the suction airstream passing out of the airflow outlet 36.

In operation, the wand 2 of a domestic vacuum cleaner intake hose (not shown) is fitted to the receptacle 44 and the vacuum cleaner (not shown) is turned on. The suction created by the vacuum cleaner impeller draws air through the handle 40 and in turn through the airflow outlet 36 and out of the body 10 of the accessory, which generates a lower velocity suction airstream velocity through the reservoir 30 and a higher suction airstream velocity through the narrow suction intake passage 20. The suction inlet 26 is placed over the spill, and as the accessory is passed back and forth over the liquid liquid droplets become entrained in the fastmoving suction airflow entering the suction inlet 26.

The liquid droplets are drawn through the suction intake passage 20. As the suction airstream is discharged from the suction outlet 28 into the lower suction airstream velocity region of the reservoir 30, liquid droplets separate from the suction airstream and fall into the reservoir 30 under the influence of inertia and gravity. The baffles 22, 24 ensure that the suction airstream must pass through the lower suction airstream velocity region of the reservoir 30 before egressing from the airflow outlet 36. The suction outlet 28 is preferably directed toward the underside of the lower baffle 24, to further isolate the suction outlet 28 from the airflow outlet 36. This also has the beneficial effects of lengthening the airflow path between the suction outlet 28 and the airflow outlet 36, which helps to ensure that all liquid has separated from the suction airstream before the airstream is drawn out of the body 10, and providing a sharp turn in the airflow path which results in some inertial separation of liquid from the airstream (in the same fashion as a centrifuge).

The accessory should be kept upright at all times during the cleaning procedure, to ensure that liquid in the reservoir 30 remains well away from the airflow outlet 36 while the suction pressure is present. When the spill has been cleaned, the vacuum cleaner is shut off and the wand 2 is detached from the receptacle 44. Liquid collected in the reservoir 30 may then be emptied by turning the accessory upside down and allowing the collected liquid to flow out of the airflow outlet 36 and the handle 40 into a sink or basin. Alternatively a resilient removable plug (not shown) may be fitted to a hole (not shown) in the back 34 of the body 10 to facilitate emptying the reservoir 30.

In cleaning spills off of fabrics such as carpet and upholstery it is generally advantageous to pass the suction inlet 26 over the spill a number of times, to remove any residual liquid which might have evaded initial passes. The suction inlet 26 is preferably formed with rounded lips 27, best seen in FIG. 2, to minimize resistance of the accessory against the fabric. A rounded glide 32 may also be provided near the rear end of the bottom 12 for the same purpose, which will additionally serve to keep the reservoir 30 level during use of the accessory.

A preferred embodiment of the invention having been thus described, it will be apparent to those skilled in the art that certain modifications and adaptations may be made without departing from the scope of the invention as delimited by the appended claims. For example, without limiting the foregoing, it will be appreciated that although the preferred embodiment of the invention is in the form of an accessory adapted to fit the intake hose of a typical vacuum cleaner, the invention can also be made integrally with a wand or hose, or otherwise attached to a vacuum cleaner, without departing from the principles of the invention.

I claim:

1. An accessory for a vacuum cleaner for cleaning liquid, comprising a body having a front wall, a rear wall, a top, side walls and a bottom, for confining a flow of air through the accessory, a suction intake passage having a suction inlet and a suction outlet, defined between a pair of baffles contained within the body rearwardly of the front wall for creating a higher suction airstream velocity region, the suction inlet being disposed along a lower portion of the front wall of the body and the suction outlet being disposed rearwardly of the suction inlet, a lower suction airstream velocity region contained within the body comprising a reservoir in communication with and disposed beneath the suction outlet, and an airflow outlet for attachment to a suction intake of the vacuum cleaner, for drawing the suction airstream out of the body of the accessory, the airflow outlet being disposed above the baffles and forwardly of the suction outlet, whereby the airflow outlet is isolated from the reservoir by the baffles such that the suction airstream must pass through the reservoir and over the baffles before egressing from the airflow outlet.

2. The accessory defined in claim 1 in which a hollow handle is provided in communication with the airflow outlet for attachment to the suction intake of the vacuum cleaner.

3. The accessory defined in claim 2 in which the handle is spaced from a top of the body to facilitate a user gripping the handle.

4. The accessory defined in claim 2 in which a rear end of the handle is provided with a receptacle.

5. The accessory defined in claim 1 in which the baffles are oriented obliquely relative to a bottom of the reservoir.

6. The accessory defined in claim 1 in which the suction outlet is directed toward an underside of the baffles.

7. The accessory defined in claim 1 in which the suction inlet projects beyond a bottom of the body the accessory.

8. The accessory defined in claim 7 in which the suction inlet is defined between a pair of rounded lips.

9. The accessory defined in claim 7 in which a rounded glide is positioned near a rear end of a bottom of the body.

10. An accessory for a vacuum cleaner for cleaning liquid, comprising a body having a front wall, a rear wall, a top, side walls and a bottom, for confining a flow of air through the accessory, a suction intake passage having a suction inlet and a suction outlet, defined between a pair of baffles contained within the body rearwardly of the front wall for creating a higher suction airstream velocity region, the suction inlet being disposed along a lower portion of the front wall of the body and the suction outlet being disposed rearwardly of the suction inlet, a lower suction airstream velocity region contained within a body of the accessory comprising a reservoir in communication with and disposed beneath the suction outlet, such that the suction airstream egressing from the suction outlet must pass through the reservoir, and an airflow outlet for attachment to a suction intake of the vacuum cleaner, for drawing the suction airstream out of the body of the accessory, the airflow outlet being disposed above the baffles and forwardly of the suction outlet, wherein the airflow outlet is isolated from the reservoir solely by the baffles.

11. The accessory defined in claim 10 in which a hollow handle is provided in communication with the airflow outlet for attachment to the suction intake of the vacuum cleaner.

12. The accessory defined in claim 11 in which the handle is spaced from a top of the body to facilitate a user gripping the handle.

13. The accessory defined in claim 10 in which the baffles are oriented obliquely relative to a bottom of the reservoir.

14. The accessory defined in claim 10 in which the suction outlet is directed toward an underside of the baffles.

15. The accessory defined in claim 10 in which the suction inlet projects beyond a bottom of the body the accessory.

16. The accessory defined in claim 15 in which a rounded glide is positioned near a rear end of a bottom of the body.

17. The accessory defined in claim 10 in which the cross sectional area of the suction passage is substantially constant throughout the suction passage.

18. The accessory defined in claim 17 in which a cross sectional area of the suction passage approximates a cross sectional area of the suction intake of the vacuum cleaner.

19. The accessory defined in claim 1 in which the cross sectional area of the suction passage is substantially constant throughout the suction passage.

20. The accessory defined in claim 19 in which a cross sectional area of the suction passage approximates a cross sectional area of the suction intake of the vacuum cleaner.

* * * * *